US006561253B1

(12) United States Patent
Hsiao

(10) Patent No.: US 6,561,253 B1
(45) Date of Patent: May 13, 2003

(54) TILT CORD PULLEYS FOR VENETIAN BLINDS

(76) Inventor: Li-Hsueh Hsiao, No. 860, Jungshan Rd., Shengang Shiang, Taichung (TW)

( * ) Notice: Subject to any disclaimer, the term of this patent is extended or adjusted under 35 U.S.C. 154(b) by 0 days.

(21) Appl. No.: 10/023,654

(22) Filed: Dec. 21, 2001

(51) Int. Cl.[7] ..... E06B 9/38
(52) U.S. Cl. ..... 160/177 R
(58) Field of Search ..... 160/177 R, 176.1 R, 160/168.1 R, 173 R, 172 R, 178.1 R

(56) References Cited

U.S. PATENT DOCUMENTS 3,333,905 A * 8/1967 Hennequin ..... 160/177 R
3,357,270 A * 12/1967 Spangenberg ..... 160/177 R
4,484,612 A * 11/1984 Vecchiarelli ..... 160/177 R
5,538,068 A * 7/1996 Liu ..... 160/177 R
5,636,677 A * 6/1997 Liu ..... 160/177 R
5,680,892 A * 10/1997 Liu ..... 160/177 R

* cited by examiner

*Primary Examiner*—David Purol
(74) *Attorney, Agent, or Firm*—Rosenberg, Klein & Lee

(57) ABSTRACT

A tilt pulley for Venetian blinds includes a tubular body and two flanges extend radially outward from two ends of the body. Each of the two flanges has a recess defined therein and two notches are defined in the body and respectively communicate with the two recesses. A central hole is defined centrally through the body and a driving rod is secured in the central hole. A passage is defined through the body and a tilt cord extends through the hole and two ends of the tilt cord are engaged with the notches and recesses.

1 Claim, 7 Drawing Sheets

TILT CORD PULLEYS FOR VENETIAN BLINDS

FIELD OF THE INVENTION

The present invention relates to a tilt cord pulley for venetian blinds and includes two notches defined in an outer surface of the pulley so as to position the tilt cord.

BACKGROUND OF THE INVENTION

Convention venetian blinds as shown in FIG. 1 include a head and a plurality of slats 20 and a bottom rail 16 are connected by wires 21. The wires 21 are controlled by the head which includes a tilt rod 12 supported between two drums 13 and a pulley assembly 10 is located in an end of the head. The pulley assembly is shown in FIGS. 2 and 3 and generally includes a pulley 15 which has two flanges 150 extending radially outward from two ends thereof and each flange 150 has a recess 151 defined therein. A driving rod 14 securely extends through a central hole 153 of the pulley 15 so as to drive the tilt rod 12. A tilt cord 11 extends through a passage 154 in the pulley 15 and two ends of the tilt cord 11 respectively extend through the two recesses 151 and then wrap around the pulley 15. When the user pulls either one of the two ends of the tilt cord 11, the tilt rod 12 is rotated and change the angles of the slats 20. However, the tilt cord 11 cannot be secured in the recesses 151 so that the tilt cord 11 could slip when being pulled and the shifted tilt cord 11 makes the tilt cord 11 loosen and cannot response the operation of the users. Although some manufacturers make a tie on the tilt cord 11 to prevent the slip of the tilt cord 11 from the recesses 151, these ties are made by manual work and are time-consuming.

SUMMARY OF THE INVENTION

In accordance with one aspect of the present invention, there is provided a tilt pulley for venetian blinds and the tilt pulley comprises a tubular body with two flanges extending radially outward from two ends of the body. Each of the two flanges has a recess defined therein, two notches defined in the body and respectively communicating with the two recesses. A central hole is defined centrally through the body and a passage is defined through the body.

The primary object of the present invention is to provide a tilt pulley for venetian blinds that has two notches communicating with two recesses in the flanges so as to secure the tilt cord which is not slip during pulling.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 5:
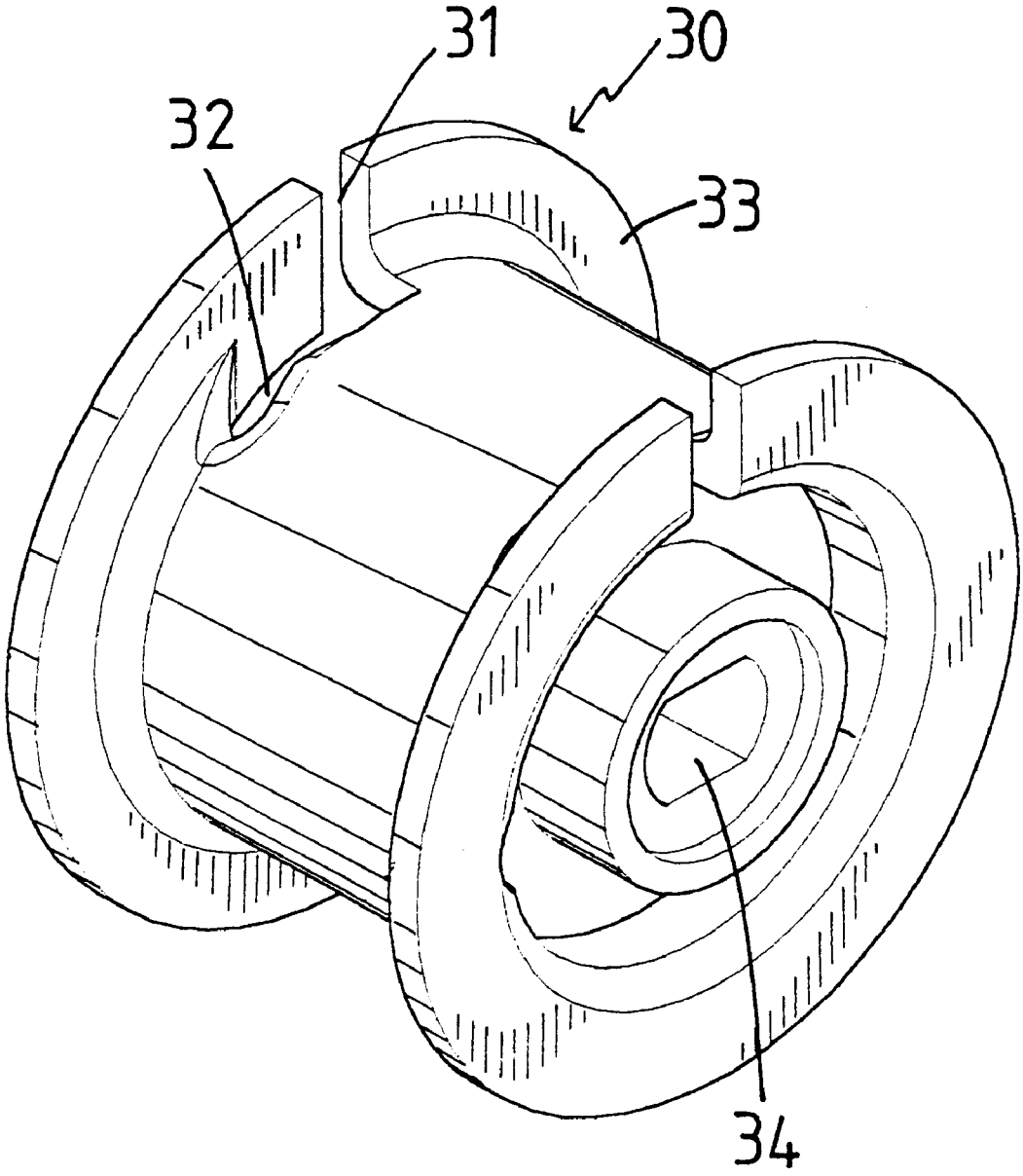
FIG. 5 is a perspective view to show the tilt pulley of the present invention.
Figure 6:
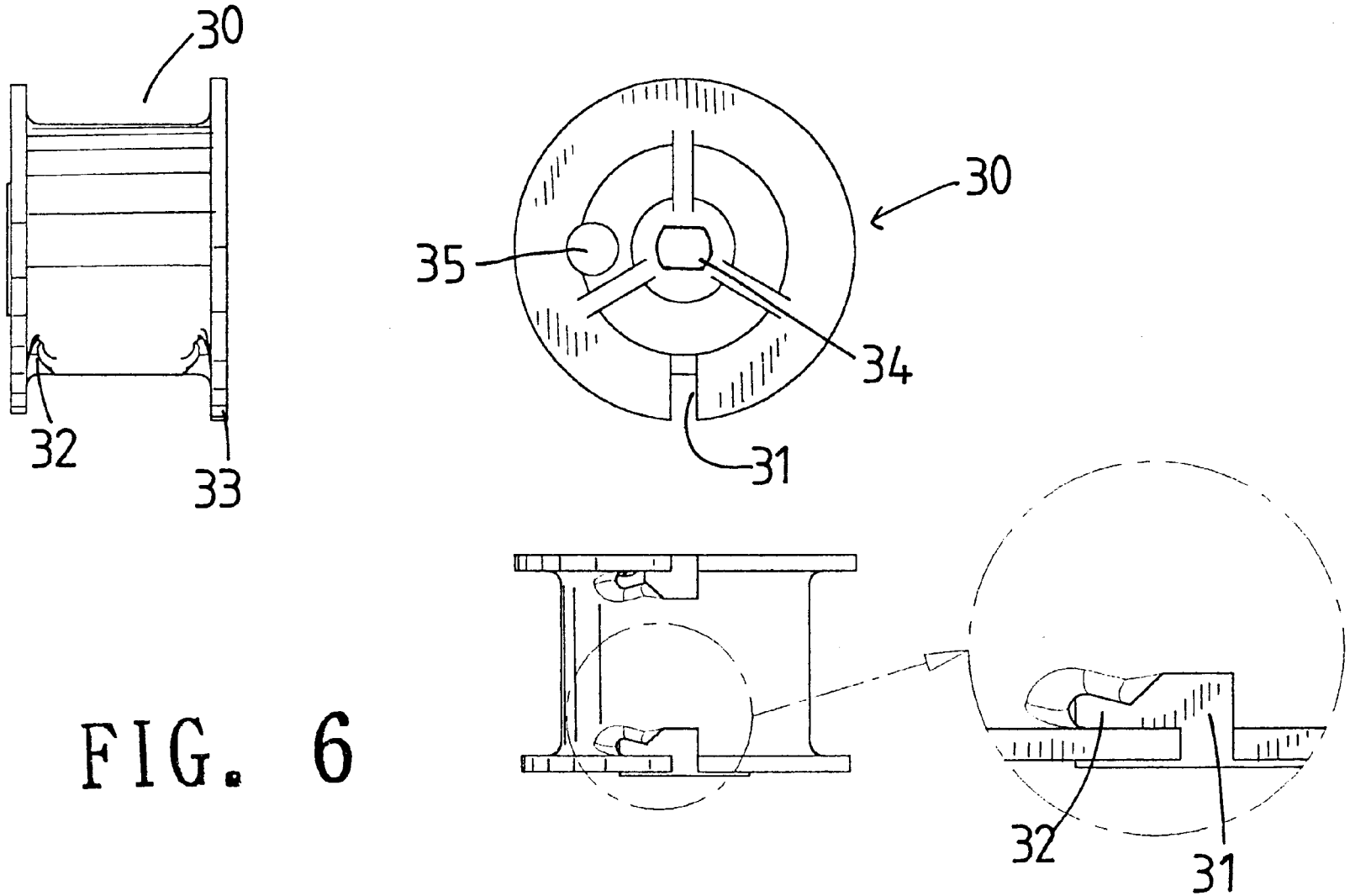
FIG. 6 shows the tilt pulley of the present invention at different side views.

Referring to FIGS. 5 and 6, the tilt pulley 30 of the present invention comprises a tubular body and two flanges 33 extend radially outward from two ends of the body. Each of the two flanges 33 has a recess 31 defined therein and two notches 32 are defined in the body and respectively communicate with the two recesses 31. A central hole 34 is defined centrally through the body and a passage 35 is defined through the body.

Figure 1:
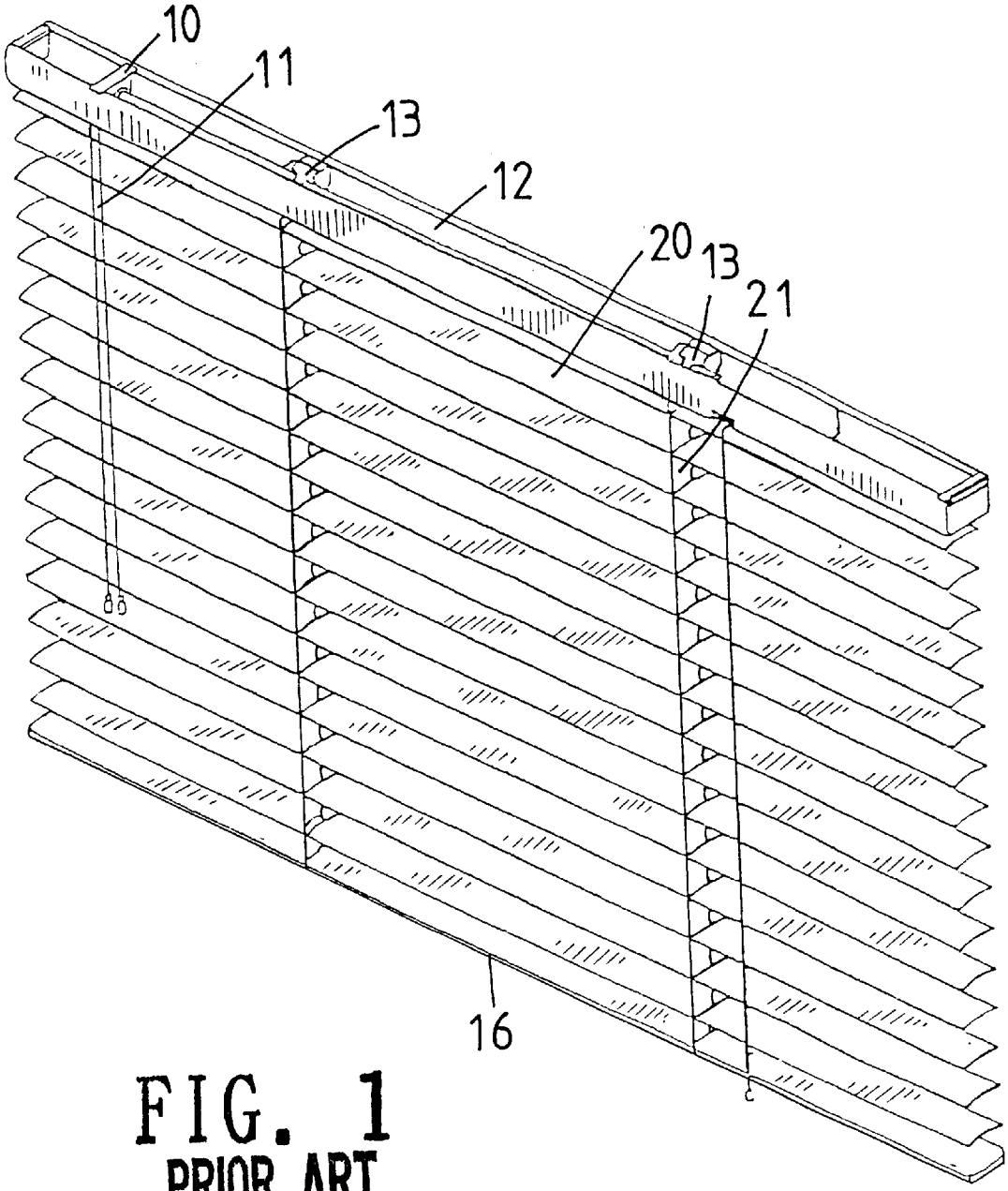
FIG. 1 PRIOR ART
FIG. 1 is a perspective view to show a conventional venetian blinds
Figure 2:
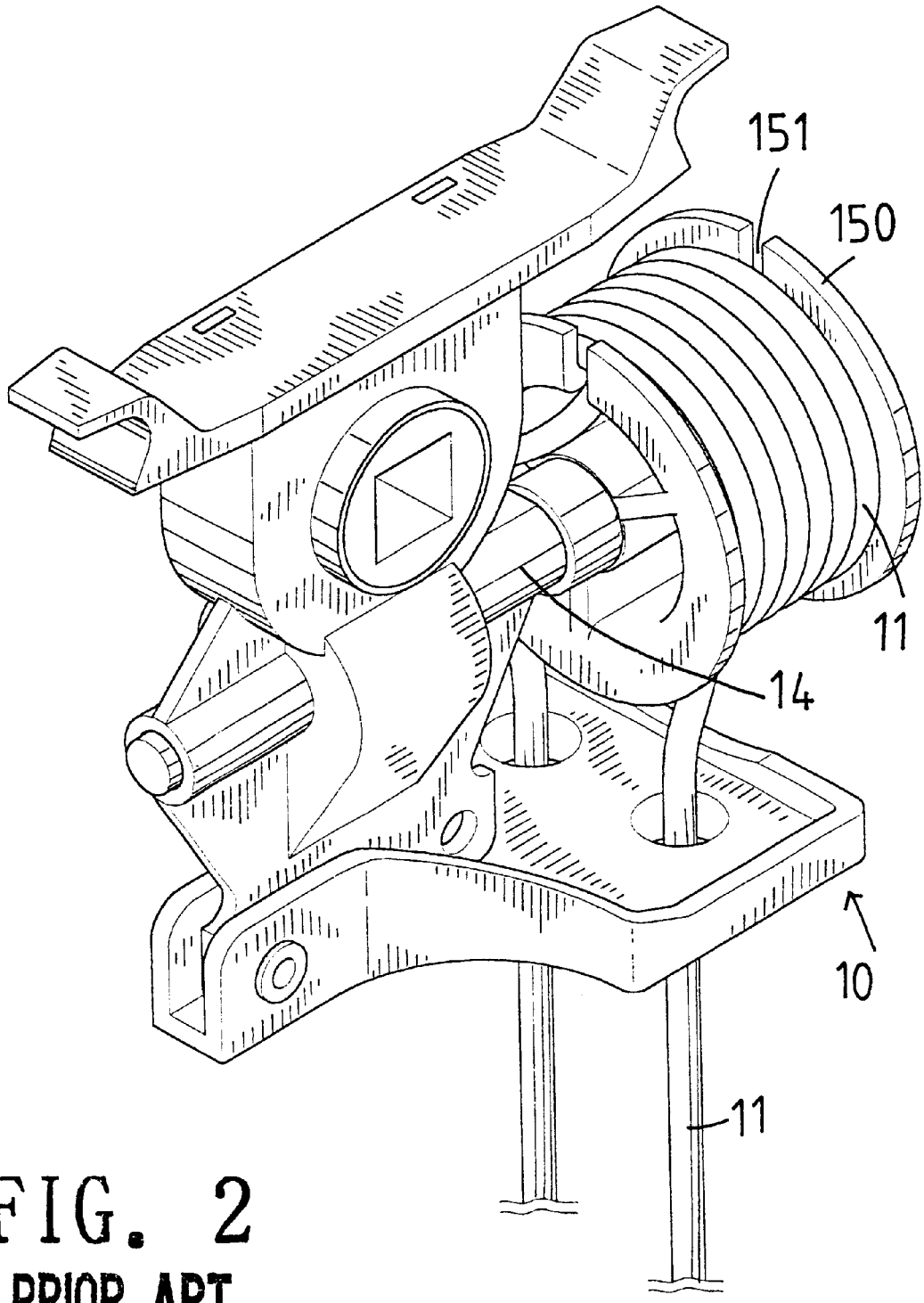
FIG. 2 PRIOR ART
FIG. 2 is a perspective view to show a conventional tilt pulley with a tilt cord wrapped on the tilt pulley.
Figure 3:
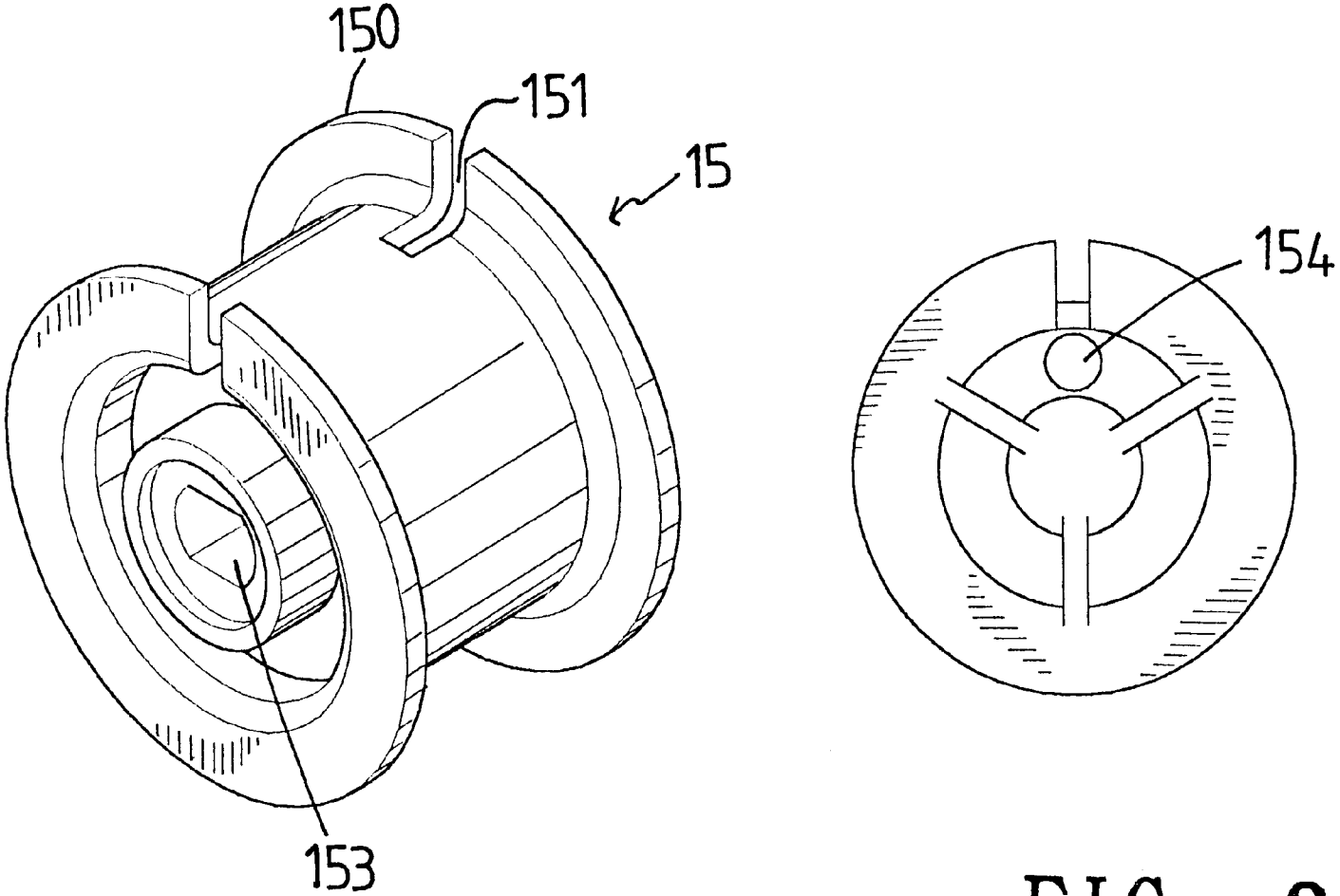
FIG. 3 PRIOR ART
FIG. 3 shows the conventional tilt pulley.
Figure 4:
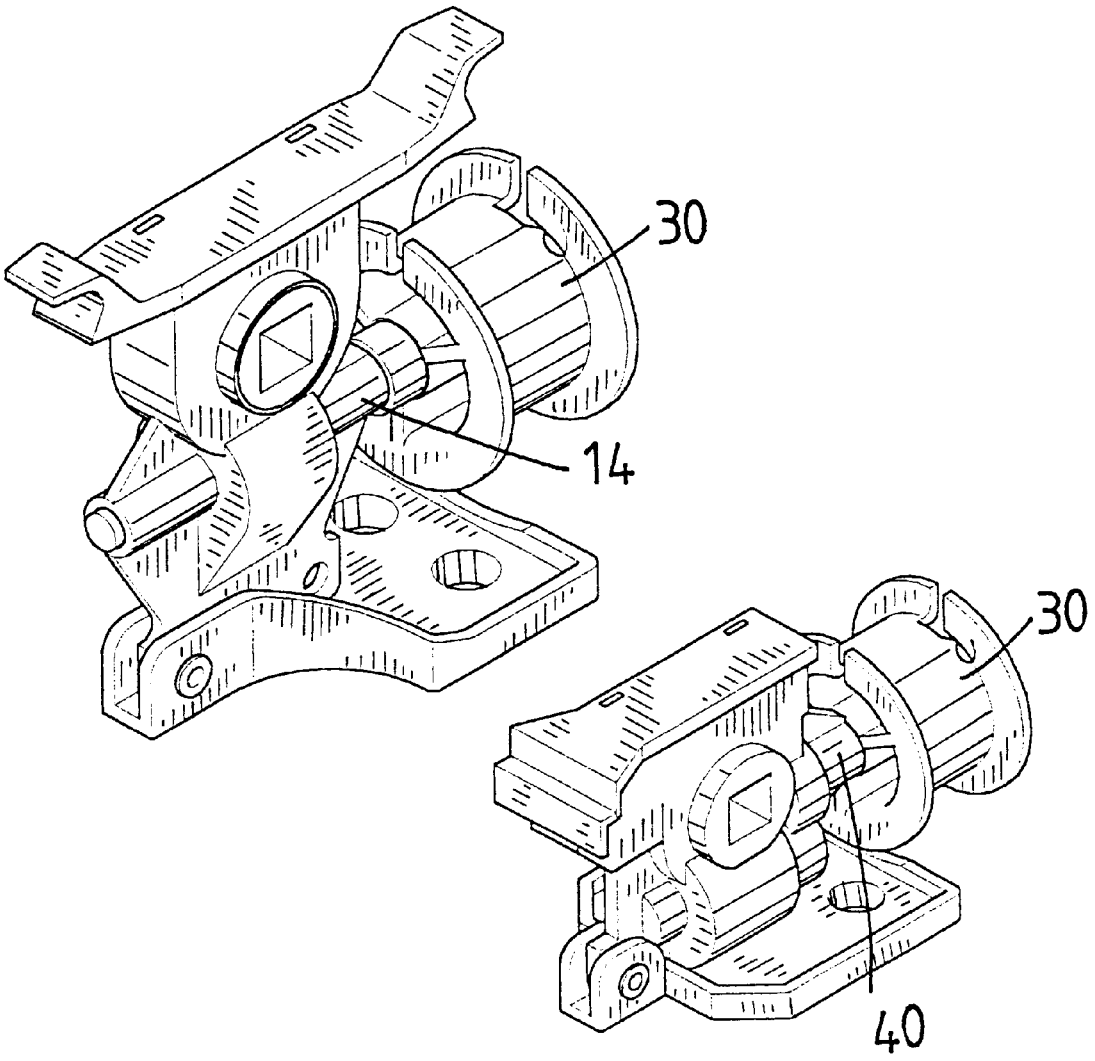
FIG. 4 is a perspective view to show the tilt pulley of the present invention with a tilt cord wrapped on the tilt pulley.
Figure 7:
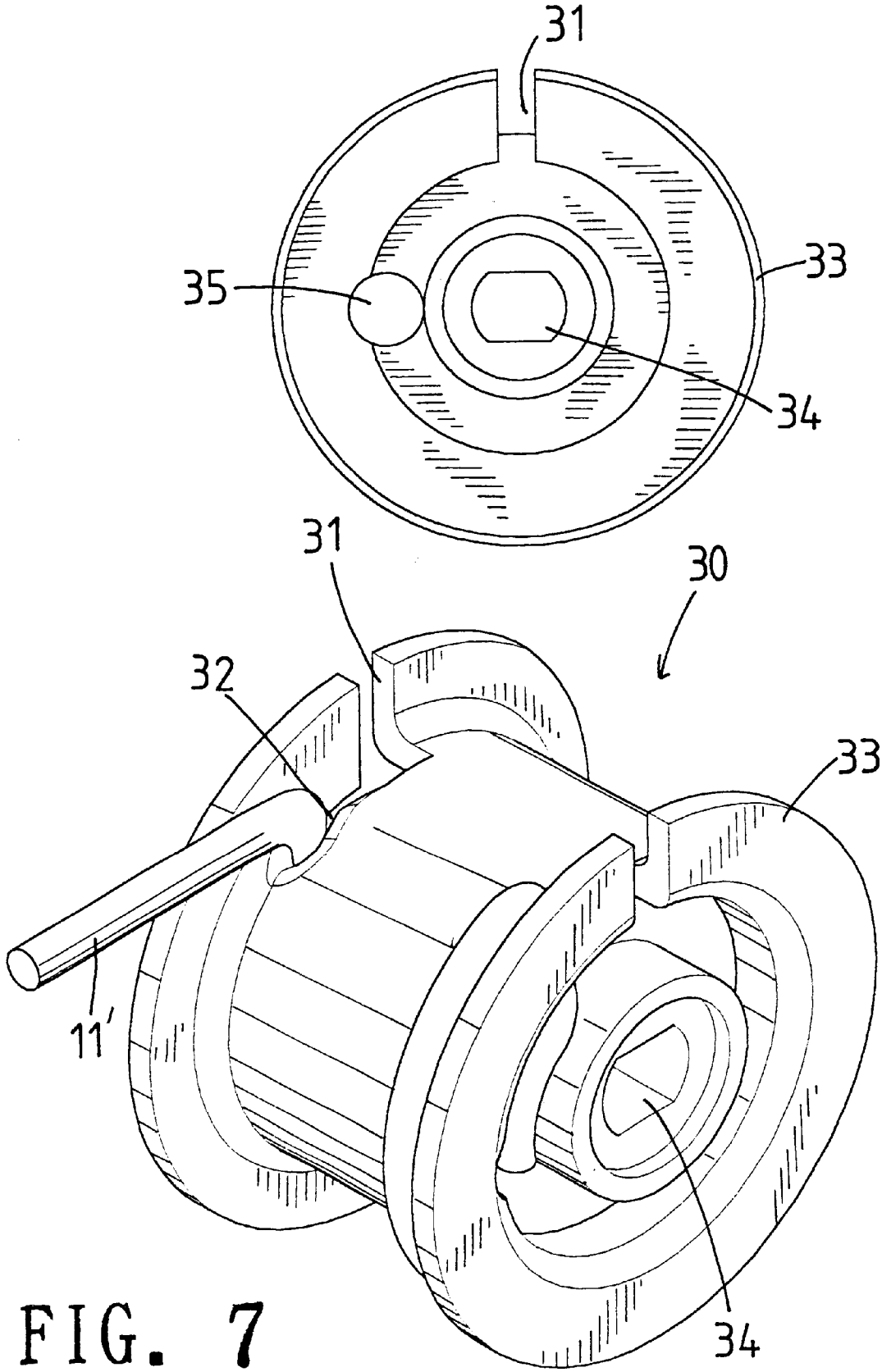
FIG. 7 shows the tilt cord is engaged with the notch in the tilt pulley of the present invention.

Referring to FIGS. 4 and 7, a tilt cord 11' extends through the passage 35 and two ends of the tilt cord 11' extend through the recesses 31 and are engaged with the notches 32, and then wrapped on the tilt pulley 30. A driving rod 40 securely extends through the central hole 34 and drives the tilt rod (not shown). The tilt cord 11' is secured by the notches 32 so that when the tilt cord 11' is pulled, the tilt cord 11' will not shifted nor slip. The size of the tilt pulley 30 of the present invention is the same as the conventional tilt pulley so that the tilt pulley 30 of the present invention can be cooperated with the present blinds in the market without too much amendments.

While we have shown and described the embodiment in accordance with the present invention, it should be clear to those skilled in the art that further embodiments may be made without departing from the scope of the present invention.

What is claimed is:

1. A tilt pulley for venetian blinds, comprising:

a tubular body and two flanges extending radially outward from two ends of the body and each of the two flanges having a recess defined therein, two notches defined radially in the two ends of the body and respectively communicating with the two recesses, each recess extending along a circumferential direction in the end of the body, a central hole defined centrally through the body and a passage defined through the body.

* * * * *